US010186239B2

(12) United States Patent
Tom

(10) Patent No.: US 10,186,239 B2
(45) Date of Patent: Jan. 22, 2019

(54) TUNE HOLDER FOR STRING INSTRUMENTS

(71) Applicant: Stephanie Tze-en Tom, Rancho Palos Verdes, CA (US)

(72) Inventor: Stephanie Tze-en Tom, Rancho Palos Verdes, CA (US)

(73) Assignee: Stephanie Tze-en Tom, Rancho Palos Verdes, CA (US)

( * ) Notice: Subject to any disclaimer, the term of this patent is extended or adjusted under 35 U.S.C. 154(b) by 0 days.

(21) Appl. No.: 15/959,133

(22) Filed: Apr. 20, 2018

(65) Prior Publication Data

US 2018/0350328 A1 Dec. 6, 2018

Related U.S. Application Data

(60) Provisional application No. 62/515,532, filed on Jun. 5, 2017.

(30) Foreign Application Priority Data

Sep. 11, 2017 (TW) ..... 106213438 U

(51) Int. Cl.
*G10D 3/14* (2006.01)

(52) U.S. Cl.
CPC ..... *G10D 3/14* (2013.01)

(58) Field of Classification Search
CPC ..... G10D 3/14
See application file for complete search history.

(56) References Cited

U.S. PATENT DOCUMENTS

2013/0008297 A1* 1/2013 Adams ..... G10D 3/14 84/304

* cited by examiner

*Primary Examiner* — Kimberly Lockett
(74) *Attorney, Agent, or Firm* — Martine Penilla Group, LLP

(57) ABSTRACT

Provided are tune holders for string instruments, comprising: a bar-like first pressing member having a rectangular first surface, the length of the first surface at least spanning across at least two tuning pegs on one side of a string instrument; a bar-like second pressing member having a rectangular second surface, the second surface facing the first surface and the length of the second surface at least spanning across the at least two tuning pegs; and a securing assembly configured to detachably connect and secure the first pressing member and the second pressing member, allowing the first and second surfaces of the first and second members to be pressed against at least two tuning pegs or separated from at least two tuning device.

18 Claims, 6 Drawing Sheets

TUNE HOLDER FOR STRING INSTRUMENTS

CROSS REFERENCE TO RELATED APPLICATIONS

This application claims priority from US Provisional Patent Application No. 62/515,532 filed on Jun. 5, 2017 and TW Patent Application No. 106213438 filed on Sep. 11, 2017, which are hereby incorporated by reference in its entirety for all purposes.

BACKGROUND OF THE INVENTION

Technical Field

The present disclosure relates to tune holders for string instruments, and more particularly to anti-loose structures which maintain the strings of a string instrument at desired tensions for an extended period.

Description of the Prior Art

String instruments produce sounds of various frequencies through vibration of their strings. Typical string instruments include violins, violas, cellos, bass cellos, guitars, bass, ukulele, etc. They need to be tuned regularly and/or irregularly to ensure optimal effects during performance and/or practicing. Generally, a string instrument may have one or more strings, one end of each string being permanently affixed while the other end being adjustably secured to a tuning structure of the string instrument. The tuning structure may allow the strings to be tightened or loosened so as to increase or reduce the tensions of the respective strings, thereby adjusting the timbre and touch of the string instrument.

As shown in FIG. 1, the tuning structure 1 of a string instrument comprises a peg-box 100 and one or more pegs 101 (also referred to as "tuning pegs" or "string pegs"). Each of the pegs 101 includes a head 103 and a shaft 105. The shaft 105 of the peg 101 may be inserted into the peg-box 100 through one of a plurality of peg-holes 102 on the peg-box 100. After the shaft 105 is inserted into the peg-box 100, an user may rotate the head 103 to drive the shaft 105 to rotate about the axis of the peg 101, thereby adjusting the tension of string(s) (not shown) wound around the shaft 105. The shaft 105 of the peg 101 is slightly tapered and fitted in a corresponding peg-hole 102 on the peg-box 100 as desired, enabling the user to rotate the peg 101 for tightening or loosening strings when performing tuning. When the tuning is completed, the peg 101 can be pushed further into the peg-hole 102 such that the peg 101 can be secured and difficult to be rotated.

In the tuning structure 1 shown in FIG. 1, the peg 101 is secured in the peg-hole 102 of the peg-box 100 only by way of the taper of the shaft 105. As a result, although the user has adjusted the tension of each string to a predetermined valve by using the tuning structure, the peg 101 would still be rotated over time due to, for example, relaxation in the tensions of strings, thermal expansion and contraction, etc., causing the tensions of strings to deviate from a predetermined valve, that is, the string instrument becomes out of tune. Therefore, the user has to tune a string instrument regularly, and/or before a performance and/or practicing. Beginners or children, who typically lack adequate tuning ability for string instruments, may need to ask for help frequently from those skilled in tuning string instruments.

SUMMARY OF THE INVENTION

One aspect of the present disclosure provides a tune holder for string instruments. The tune holder comprises a bar-like first pressing member having a rectangular first surface, a bar-like second pressing member having a rectangular second surface, and at least one securing assembly. The length of the first surface may be configured to at least span across at least two tuning pegs located on one side of a string instrument. The second surface is opposite to the first surface, and the length of the second surface may be configured to at least span across the at least two tuning pegs located on the one side of the string instrument. The at least one securing assembly may be configured to connect and secure the first pressing member and the second pressing member in a detachable manner. When the tune holder is mounted onto the at least two tuning pegs, the first and second surfaces may be pressed against the at least two tuning pegs by the at least one securing assembly, and when the tune holder is removed from the at least two tuning pegs, the first and second pressing members may be released by the at least one securing assembly, such that the first and second surfaces are separated from the at least two tuning pegs.

In some embodiments, at least one of the first and second surfaces is provided with a pad, a coating, or is ridged on portions of the first and second surfaces abutting against the at least two tuning pegs.

In some embodiments, the at least one securing assembly may partially or entirely be integrated with at least one of the first and second pressing members.

In some embodiments, at least one securing assembly may comprise at least one of a threaded securing structure, a buckling structure, and a cam structure.

In some embodiments, the threaded securing structure may include a rod with a threaded segment and an adjusting portion with an internal threaded hole. The threaded segment may mate with the internal threaded hole such that the first and second pressing members may be pressed against at least two tuning pegs of a string instrument or separated from the at least two tuning pegs of the string instrument.

In some embodiments, one end of the rod of the threaded securing structure may be affixed in the first pressing member, and the other end may pass through the second pressing member via a through-hole disposed in the second pressing member.

In some embodiments, one end of the rod of the threaded securing structure may be affixed at an end position or a middle position on the first pressing member, or at a position between the end position and the middle position.

In some embodiments, one end of the rod of the threaded securing structure may be affixed in the first pressing member with an adhesive.

In some embodiments, the rod of the threaded securing structure may be at an angle from the first surface of the first pressing member. The angle may be about 90°.

In some embodiments, the adjusting portion may be manually rotatable without a tool.

In some embodiments, the adjusting portion may be a knurled nut, a wing nut, or a nut having a polygonal cross section.

In some embodiments, the buckling structure may include a buckle clip and a buckle base. Through the matching between the buckle clip and the buckle base, the buckling structure may allow the first and second pressing members to be pressed against at least two tuning pegs or separated from at least two tuning pegs.

In some embodiments, the buckle clip of the buckling structure may have a hole which is shaped and sized to match a corresponding portion of the buckle base. The corresponding portion of the buckle base may engage the hole when the buckle clip and the buckle base are pressed together.

In some embodiments, the buckle clip of the buckling structure may be hook-shaped, and a portion of the second pressing member is configured to act as the base.

In some embodiments, the cam structure may include a cam. By rotation of the cam in different directions, the cam structure may allow the first and second pressing members to be pressed against at least two tuning pegs or separated from at least two tuning pegs.

BRIEF DESCRIPTION OF THE DRAWINGS

The drawings listed below are not necessarily drawn to scale.

DETAILED DESCRIPTION OF THE PREFERRED EMBODIMENTS

In the following description, numerous specific details are set forth to provide a thorough understanding of the presented embodiments. The disclosed embodiments may be practiced without some or all of these specific details. In other instances, well known components have not been described in detail to not unnecessarily obscure the disclosed embodiments. While the disclosed aspects will be described in conjunction with specific embodiments, it will be understood that it is only for illustrative and non-limiting purposes.

The present disclosure provides tune holders for string instruments. These tune holders are used to firmly secure the pegs with respect to the peg-box so that the pegs do not unexpectedly rotate, enabling the strings wound around the pegs to be maintained at a predetermined tension for a longer period of time.

Figure 1:
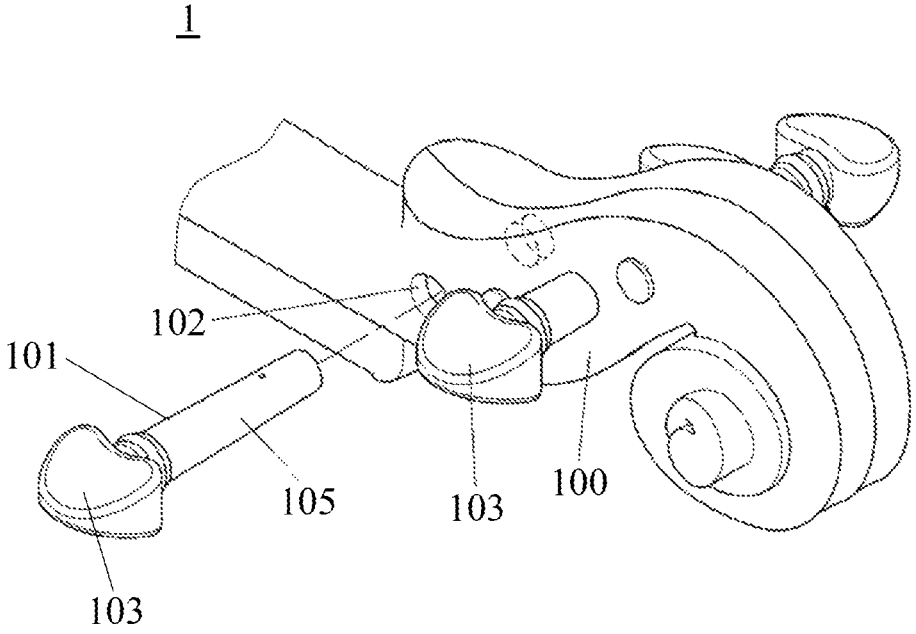
FIG. 1 (PRIOR ART)
FIG. 1 is a schematic view illustrating the partial structure of a conventional string instrument.
Figure 2:
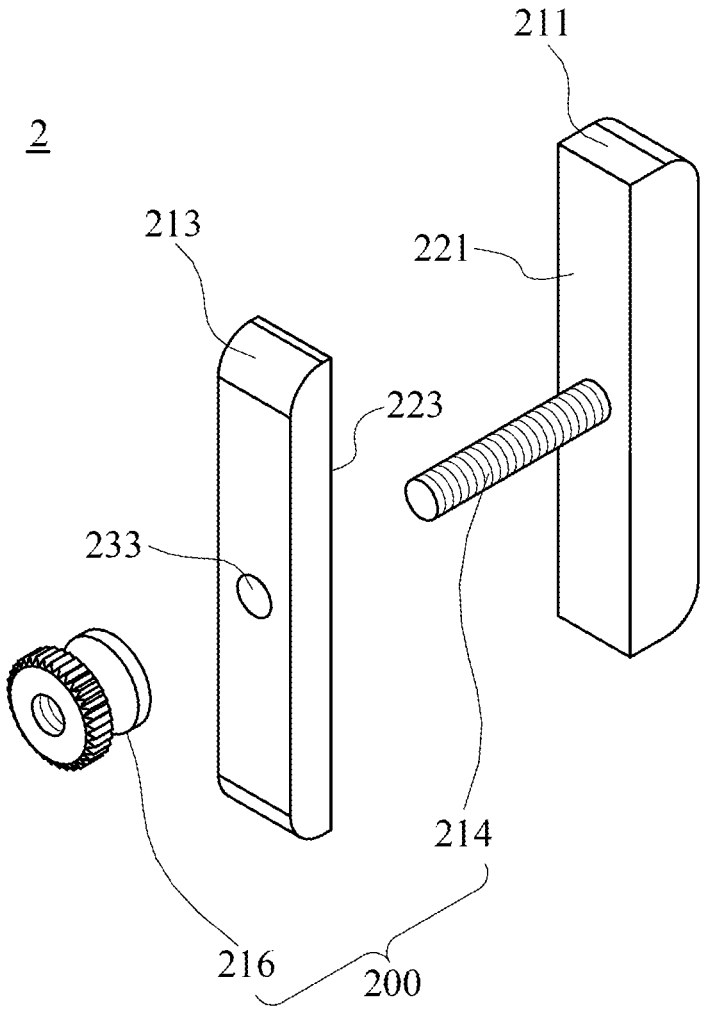
FIG. 2 is an exploded perspective view of a tune holder for string instruments according to one embodiment of the present disclosure.
Figure 3:
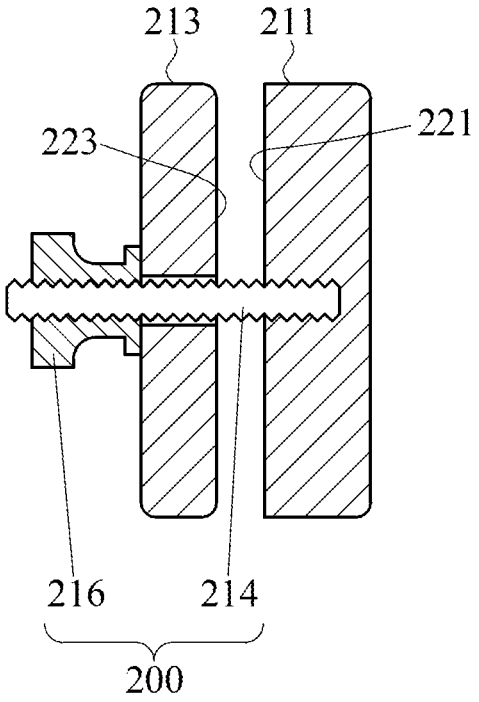
FIG. 3 is a schematic sectional view of the tune holder for string instruments shown in FIG. 2.
Figure 4:
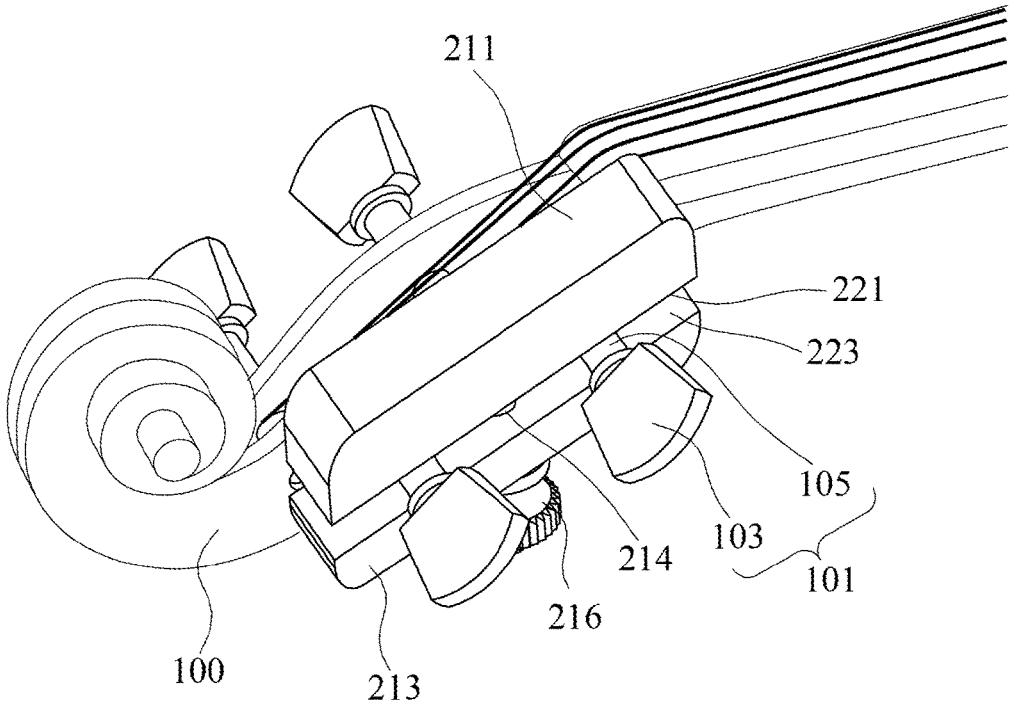
FIG. 4 is a schematic in-use view of the tune holder for string instruments shown in FIG. 2.
Figure 5:
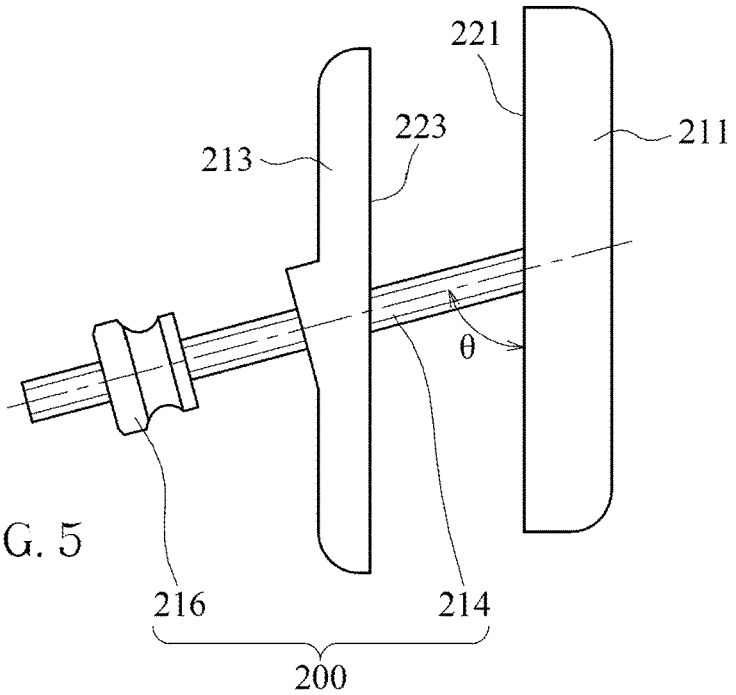
FIGS. 5-6 are schematic side views of tune holders for string instruments according to various embodiments of the present disclosure.

As shown in FIG. 2, in one aspect of the present disclosure, a tune holder 2 for string instruments includes a first pressing member 211, a second pressing member 213, and a securing assembly 200 such as a threaded securing structure. For example, the first and second pressing members 211, 213 may each be bar-like, and may respectively have a rectangular first surface 221 and a rectangular second surface 223, with the first surface 221 and the second surface 223 being opposite to each other. The securing assembly 200 may include a rod 214 and an adjusting portion 216. When the first and second pressing members 211, 213 are mounted to at least two pegs 101 located on one side of a peg-box 100 (as shown in FIG. 4), the first surface 221 and the second surface 223 of the first and second pressing members 211, 213 can be moved toward each other or away from each other (that is, the first surface 221 and the second surface 223 are driven press against the at least two pegs 101 or separate from the at least two pegs 101) through the matching between the rod 214 with a threaded segment and the adjusting portion 216 with an internal threaded hole of the securing assembly 200. Referring to FIG. 3, for example, one end of the rod 214 of the securing assembly 200 may go through the first surface 221 of the first pressing member 211 and be affixed in the first pressing member 211. For example, one end of the rod 214 may be affixed in the first pressing member 211 by using an adhesive such as epoxy, although other affixing configuration such as a threaded structure can also be used. The rod 214 may be configured to be perpendicular to the first surface 221 of the first pressing member 211. However, as shown in FIG. 5, the rod 214 may alternatively be angled by an angle Θ from the first surface 221 of the first pressing member 211. Returning to FIG. 2, for example, a through-hole 233 through which one end of the rod 214 may penetrate the second pressing member 213 may be disposed in the bar-like second pressing member 213. The first and second surfaces 221, 223 may be substantially parallel to each other. When viewed along the axial direction of the rod, the first and second surfaces 221, 223 may be configured to at least partially overlap each other in the direction(s) of length and/or width thereof. For example, the adjusting portion 216 may be a knurled nut, a wing nut, a nut with a polygonal cross section, or any other components which can be rotated manually to move back and forth along the rod 214 without using a tool.

In some embodiments, the securing assembly 200 may be partially or entirely integrated with at least one of the first pressing member 211 and the second pressing member 213.

Figure 6:
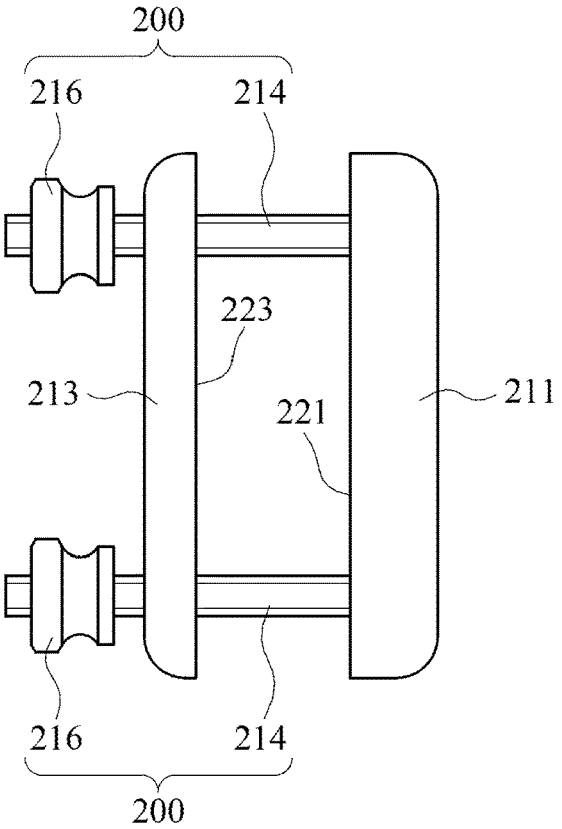

In some embodiments, the length of the first surface 221 and the length of the second surface 223 are respectively configured to at least span across at least two pegs 101 located on one side of the peg-box 100. In other embodiments, the lengths of the first and second pressing members may be lengthened or shortened as required. As shown in FIG. 6, there may be more than one securing assembly 200 provided in one tune holder 2 for string instruments. In an embodiment where the tune holder 2 for string instruments is provided with one securing assembly 200, one end of the rod 214 of the securing assembly 200 may be affixed at but not limited to a substantially middle position of the first pressing member 211 so as to achieve a desired clamping effect. In an embodiment where the tune holder for string instruments is provided with two securing assemblies 200 as shown in FIG. 6, one end of the rod 214 of each securing assembly 200 may be affixed at one of the two end positions of the bar-like first pressing member 211. As a result, the positon where the rod of the securing assembly is affixed in the pressing member may be determined depending on a desired clamping design.

In some embodiments, the first and second pressing members can be made from the same or different materials such as wood, metal, plastic, or ceramic. In some embodiments, the selected wood is preferably a hardwood such as ebony, rosewood, boxwood, maple and the like.

In some embodiments, at least one of the first and second surfaces which abut against the tuning pegs may be provided with a pad, a coating, or may be ridged. When the tune holder is mounted onto the tuning structure of a string instrument, the portion(s) of the first and/or second surfaces provided with a pad and/or a coating, and/or the ridged portion(s) of the first and/or second surfaces may be configured to further prevent the pegs from rotating between the pressing members, act as buffers for the pressing members when they abut against the pegs, and/or serve to protect the pegs from being scratched.

Figure 7A:
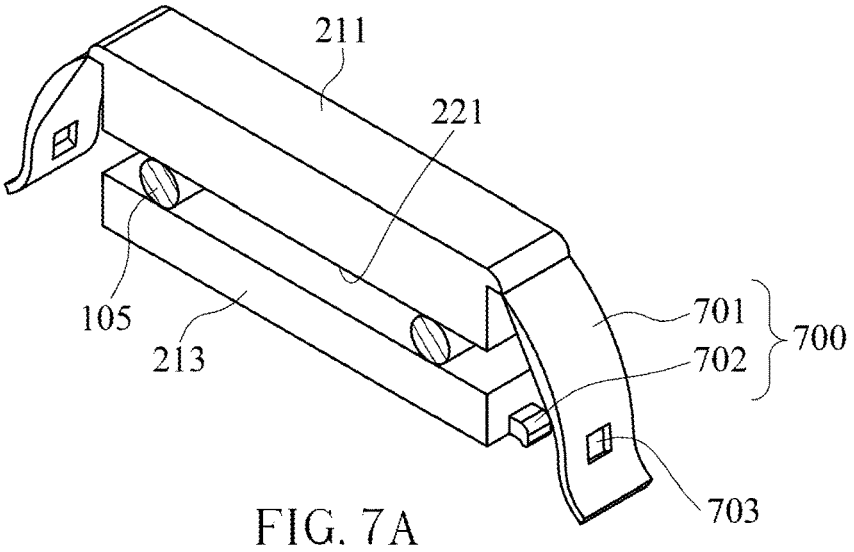
FIG. 7A is a schematic perspective view of a tune holder for string instruments according to another embodiment of the present disclosure.
Figure 7B:
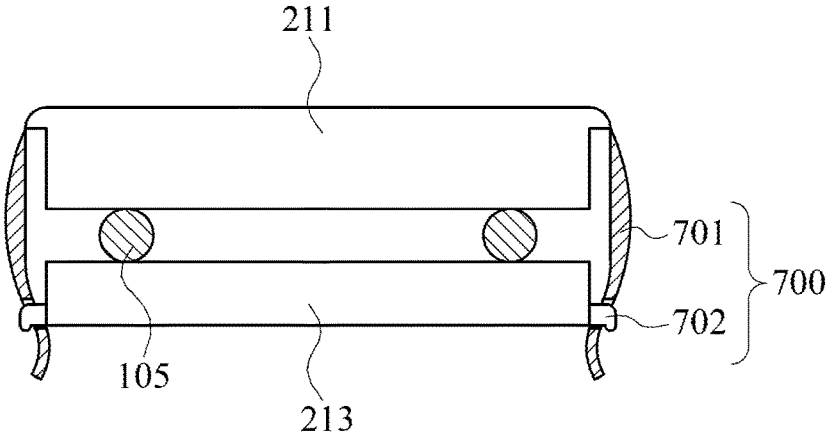
FIG. 7B is a schematic side sectional view of the tune holder for string instruments in FIG. 7A.
Figure 8:
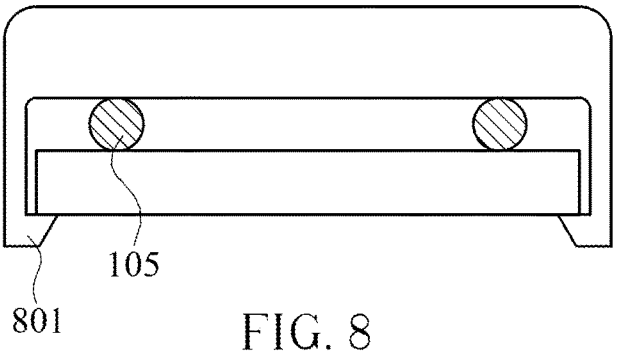
FIG. 8 is a schematic view of a tune holder for string instruments according to a further embodiment of the present disclosure.

As shown in FIGS. 7A-7B, in another aspect of the present disclosure, a securing assembly 700 may be a buckling structure comprising a buckle clip 701 and a buckle base 702, for example. Through the matching between the buckle clip 701 and the buckle base 702, the buckling structure allows the first and second pressing members 211, 213 to be pressed against or separated from at least two tuning pegs. Further, the buckle clip 701 may have a hole 703 which is shaped and sized to match the buckle base 702. When the buckle clip 701 is pressed onto the buckle base 702, a corresponding part of the buckle base 702 may engage the hole 703 of the buckle clip 701, enabling the first and second pressing members 211, 213 to be apart from each other by a predetermined distance and apply a predetermined pressure to the pegs between the first and second surfaces 221, 223. The buckle clip 701 may be provided at end positions of the first pressing member 211 in any suitable manner or be integrated with the first pressing member 211, while the buckle base 702 may be provided at end positions of the second pressing member 213 in any suitable manner or be integrated with the second pressing member 213. In other embodiments, only one end of the first pressing member 211 may be provided with the buckle clip 701 corresponding to the buckle base 702 disposed at one end of the second pressing member 213, with the other end of the first pressing member 211 connected to the other end of the second pressing member 213. FIG. 7B is a schematic sectional view of the tune holder of FIG. 7A. In addition, the buckle clip and the buckle base of the buckling structure may take other forms. For example, as shown in FIG. 8, the buckle clip may take the form of a hook 801, and in this case, the buckle base may be omitted.

In other aspects of the present disclosure, the securing assembly may include a cam structure comprising a cam. By way of the rotation of the cam in different directions, the cam structure allows the first and second pressing members to be pressed against or separated from at least two tuning pegs.

The various embodiments disclosed above facilitate preventing the pegs of a string instrument from rotating after the string instrument has been tuned, such that strings wound around the pegs may be maintained at a predetermined tension for a relatively long period resulting in less frequent inspection and tuning. Specifically, the tune holder for string instruments provided in the present disclosure can effectively prevent pegs from undesirable movements when being unintendedly touched, mitigate string tension shifting from a predetermined valve over time and/or with environment changes, and reduce the frequency of tuning.

The above embodiments are provided only for the purpose of illustration and description. Some features of a particular embodiment are not limited to that particular embodiment, and can be interchangeably used in various embodiments where applicable. All of the above embodiments are not for limiting purposes and not limited to the details given herein.

The invention claimed is:

1. A tune holder for string instruments, comprising:

a first pressing member which is bar-like and has a rectangular first surface, with a length, length of the first surface configured to at least span across at least two tuning pegs located on one side of a string instrument;

a second pressing member, which is bar-like and has a second surface which is rectangular, the second surface being opposite to the first surface, the length of the second surface configured to at least span across the at least two tuning pegs; and at least one securing assembly configured to connect and secure the first pressing member and the second pressing member in a detachable manner, wherein when the tune holder is mounted onto the at least two tuning pegs, the first surface and the second surface are pressed against the at least two tuning pegs by the at least one securing assembly, and wherein when the tune holder is removed from the at least two tuning pegs, the first and second pressing members are released by the at least one securing assembly, such that the first and second surfaces are separated from the at least two tuning pegs.

2. The tune holder of claim 1, wherein at least one of the first surface and the second surface is provided with a pad on portions of the at least one of the first and second surfaces abutting against the at least two tuning pegs.

3. The tune holder of claim 1, wherein at least one of the first surface and the second surface is provided with a coating on portions of the at least one of the first and second surfaces abutting against the at least two tuning pegs.

4. The tune holder of claim 1, wherein at least one of the first surface and the second surface is ridged on portions of the at least one of the first and second surfaces abutting against the at least two tuning pegs.

5. The tune holder of claim 1, wherein the at least one securing assembly is partially or entirely integrated with at least one of the first and second pressing members.

6. The tune holder of claim 1, wherein the at least one securing assembly includes at least one of a threaded securing structure, a buckling structure, and a cam structure.

7. The tune holder of claim 6, wherein the threaded securing structure comprises a rod with a threaded segment and an adjusting portion with an internal threaded hole, and wherein the threaded segment mates with the internal threaded hole such that the first and second pressing members are pressed against the at least two tuning pegs or separated from the at least two tuning pegs.

8. The tune holder of claim 7, wherein one end of the rod is affixed in the first pressing member, and the other end passes through the second pressing member via a through-hole disposed in the second pressing member.

9. The tune holder of claim 8, wherein the one end of the rod is affixed at an end position or a middle position on the first pressing member, or at a position between the end position and the middle position.

10. The tune holder of claim 8, wherein the one end of the rod is affixed in the first pressing member with an adhesive.

11. The tune holder of claim 7, wherein the rod is at an angle from the first surface of the first pressing member.

12. The tune holder of claim 11, wherein the angle is about 90°.

13. The tune holder of claim 7, wherein the adjusting portion is manually rotatable without a tool.

14. The tune holder of claim 13, wherein the adjusting portion is a knurled nut, a wing nut, or a nut having a polygonal cross section.

15. The tune holder of claim 6, wherein the buckling structure comprises a buckle clip and a buckle base, and wherein through the matching between the buckle clip and the buckle base, the buckling structure allows the first and second pressing members to be pressed against the at least two tuning pegs or separated from the at least two tuning pegs.

16. The tune holder of claim 15, wherein the buckle clip is provide with a hole which is shaped and sized to match a corresponding portion of the buckle base, and wherein when pressing the buckle clip onto the buckle base, the corresponding portion of the buckle base engages the hole.

17. The tune holder of claim 15, wherein the buckle clip is hook-shaped, and wherein a portion of the second pressing member is configured to acts as the buckle base.

18. The tune holder of claim 6, wherein the cam structure comprises a cam, and wherein by rotation of the cam in different directions, the cam structure allows the first and second pressing members to be pressed against the at least two tuning pegs or separated from the at least two tuning pegs.

* * * * *